United States Patent [19]

Pike

[11] 4,196,892

[45] Apr. 8, 1980

[54] APPARATUS FOR EQUALIZING TOP GAS PRESSURE IN A BLAST FURNACE

[75] Inventor: Daniel E. Pike, Harrington Park, N.J.

[73] Assignee: Air Pollution Industries, Englewood, N.J.

[21] Appl. No.: 821,552

[22] Filed: Aug. 26, 1977

Related U.S. Application Data

[63] Continuation of Ser. No. 667,627, Mar. 17, 1976, Pat. No. 4,082,253.

[51] Int. Cl.[2] ..... C21B 7/22

[52] U.S. Cl. ..... 266/147; 266/159

[58] Field of Search ..... 266/44, 88, 89, 147, 266/156, 157, 183, 159, 199; 261/DIG. 54; 75/41

[56] References Cited

U.S. PATENT DOCUMENTS

| | | | |
|---|---|---|---|
| 2,702,699 | 2/1955 | Kinney | 266/147 |
| 3,041,059 | 6/1962 | Powell | 266/147 |
| 3,045,996 | 7/1962 | Rice | 266/147 |
| 3,297,432 | 1/1967 | Mohr, Jr. | 266/89 X |
| 3,343,825 | 9/1967 | Tsutsumi et al. | 266/89 |
| 3,735,970 | 5/1973 | Genge | 266/156 X |
| 3,841,061 | 10/1974 | Pike | 261/DIG. 54 X |
| 3,877,488 | 4/1975 | Baturay et al. | 261/DIG. 54 X |
| 4,057,602 | 11/1977 | Kolm | 261/DIG. 54 X |

FOREIGN PATENT DOCUMENTS

| | | | |
|---|---|---|---|
| 47-44405 | 9/1972 | Japan | 266/89 |

*Primary Examiner*—Paul A. Bell

*Attorney, Agent, or Firm*—Sommers & Sommers

[57] ABSTRACT

An apparatus for equalizing top gas pressure exerted on the bottom surface of the large bell operating in the large bell hopper in a top closing device for a blast furnace, so as to enable opening of the large bell for the feeding of charge therethrough during operation of the blast furnace of any top gas pressure, including a venturi scrubber, located at the top or in the vicinity of the blast furnace, connected by ducts to the uptake or other gas main for furnace top gas, and a separator, mounted at the top or in the vicinity of the blast furnace, connected by ducts to the venturi scrubber and large bell hopper, which elements scrub the furnace top gas and direct scrubbed top gas into the large bell hopper, so as to exert equalizing pressure on the large bell with scrubbed top gas, and further including an ejector, mounted in the venturi scrubber, which maintains a continuous flow of scrubbed top gas into the large bell hopper, so as to maintain equalizing pressure therein.

3 Claims, 5 Drawing Figures

APPARATUS FOR EQUALIZING TOP GAS PRESSURE IN A BLAST FURNACE

This application is a continuation of application Ser. No. 667,627 filed Mar. 17, 1976 now U.S. Pat. No. 4,082,253 issued Apr. 4, 1978.

BACKGROUND OF THE INVENTION

This invention relates generally to blast furnaces, and relates specifically to an apparatus for equalizing pressure exerted on a device for feeding charge into a blast furnace.

A blast furnace is a tall shaft furnace which includes a cylindrical bottom portion, from which rises an upwardly-widening conically tapered bosh portion, surmounted by a taller tapered shaft structure which narrows towards the top, where it is closed by means of a top closing device which may include a small bell movably mounted in a small bell hopper, a large bell movably mounted in a large bell hopper, and an operating mechanism connected to the small bell and large bell for controlling the movement thereof. Such a furnace is operable to produce pig iron from charge fed stepwise through the top closing device. During such operation thereof, a gas known as "top gas" which includes carbon monoxide pollutants therein is formed in the blast furnace. Such top gas exerts full furnace pressure on the bottom surface of the large bell in the top closing device, which pressure is counterbalanced by the weight of the charge and the force exerted through the operating mechanism on the top surface of the large bell.

Presently, blast furnaces are operated at higher internal pressures so as to generate denser mixtures of gases which provide closer contact between the ore and the gases and generate increased production of pig iron. However, such higher internal pressures generate higher top gas pressures, which are not equalized by the weight of the charge and the force exerted through the operating mechanism, and therefor interfere with and prevent opening of the large bell for charging of the blast furnace.

Devices presently used to equalize the increased top gas pressure exerted on the bottom surface of the large bell direct gas from a remote location in the blast furnace system into the large bell hopper via lengthy ducts connected to scrubbers remotely located in the blast furnace system which remove pollutants from furnace gas enabling venting thereof to atmosphere. However, such presently used devices generate substantial pressure drops in the scrubbers and through the lengthy ducts connecting the remotely located scrubbers with the large bell hopper, which prevents equalization of such increased top gas pressure. Furthermore, such lengthy ducts connecting the remotely located scrubbers with the large bell hopper required extensive support systems for support thereof at substantial elevations above ground level, which exposed such ducts to ambient weather conditions, whereby during winter condensation in such ducts would freeze, interfering with operation thereof.

Such presently used devices further included a valve located at the interface of the large bell hopper and the ducts connecting the remotely located scrubber therewith. Such valve controls the flow of scrubbed gas into the large bell hopper. However, if such valve did not close completely, by virtue of sticking or inefficient operation thereof, upon opening of the large valve during the feeding of charge therethrough into the blast furnace, there was a back flow of polluted furnace gas into the scrubbed gas in the ducts leading into the large bell hopper, which pollutants were vented to atmosphere during opening of the small bell for feeding charge therethrough into the large bell hopper, thereby polluting the atmosphere. Furthermore, the frequent opening and closing of such valve during equalizing operation generated pockets of stagnent gas fromed in the lengthly ducts leading into the large bell hopper.

Such presently used devices included a further valve connected to the duct leading from the scrubbers to the large bell hopper, operable in the event of an explosion or slip in the blast furnace so as to vent scrubbed gas to atmosphere to relieve such pressure. However, as the lengthy ducts leading from the blast furnace to the scrubbers and from the scrubbers to the large bell hopper were remotely located from the blast furnace, such valve was inefficient in responding in a timely and adequate manner to such pressure surges.

SUMMARY OF THE INVENTION

In view of the foregoing problems associated with presently used devices, one of the objects of this invention is to provide an apparatus for equalizing pressure exerted on a device for feeding charge into a blast furnace, which does not generate substantial pressure drops therein, so as to enable efficient equalization of increased top pressure. Another object of this invention is to provide such an apparatus which minimizes exposure of the elements thereof to weather conditions, so as to prevent interference therefrom with the operation thereof. Still another object of this invention is to provide such an apparatus which prevents back flow and venting of polluted furnace gas to atmosphere, and which prevents the formation of pockets of stagnant gas therein. Still another object of this invention is to provide such an apparatus which efficiently and effectively responds to pressure surges in the furnace.

The foregoing objects, as well as others, are provided for in this invention by means of an apparatus for equalizing top gas pressure exerted on the bottom surface of a large bell operable in a large bell hopper in a top closing device for a blast furnace, so as to enable opening of the large bell of the feeding of charge therethrough during operation of the blast furnace at high top gas pressure, including a venturi scrubber, located at the top or in the vicinity of the blast furnace, connected by ducts to the uptake for furnace top gas, and a separator, mounted at the top or in the vicinity of the blast furnace, connected by ducts to the venturi scrubber and large bell hopper, which elements scrub the furnace top gas and direct scrubbed top gas into the large bell hopper, so as to exert equalizing pressure upon the large bell with scrubbed top gas, which elements so located do not generate substantial pressure drops therein, so as to enable equalization of the increased top gas pressure, and further including an ejector, mounted in the venturi scrubber, which maintains a continuous flow of scrubbed top gas into the large bell hopper so as to maintain equalizing pressure therein, and which prevents back flow and venting of polluted gas to atmosphere and prevents the formation of pockets of stagnant gas. A valve mounted in such apparatus effectively and efficiently responds to pressure surges in the furnace.

DESCRIPTION OF THE DRAWINGS

This invention is illustrated, by way of example thereof, in the accompanying drawings, wherein.

DESCRIPTION OF THE PREFERRED EMBODIMENT

Figure 1:
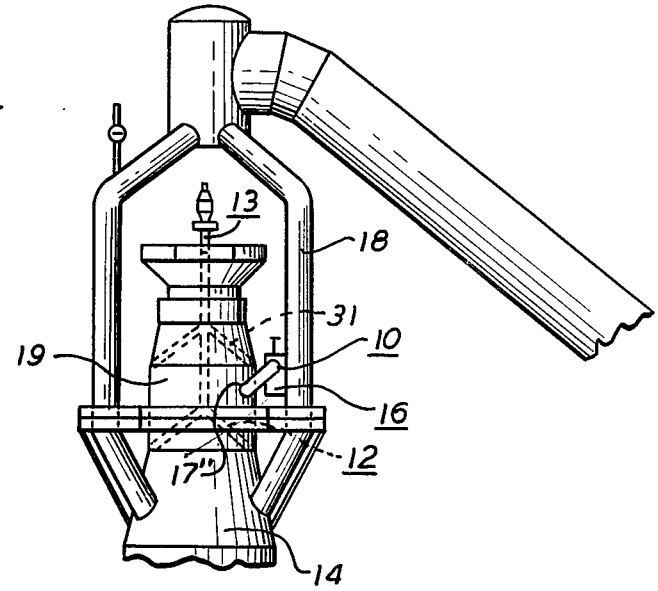
FIG. 1 is an elevational partly-fragmentary view of the top of a blast furnace with the pressure equalizing apparatus connected thereto.
Figure 2:
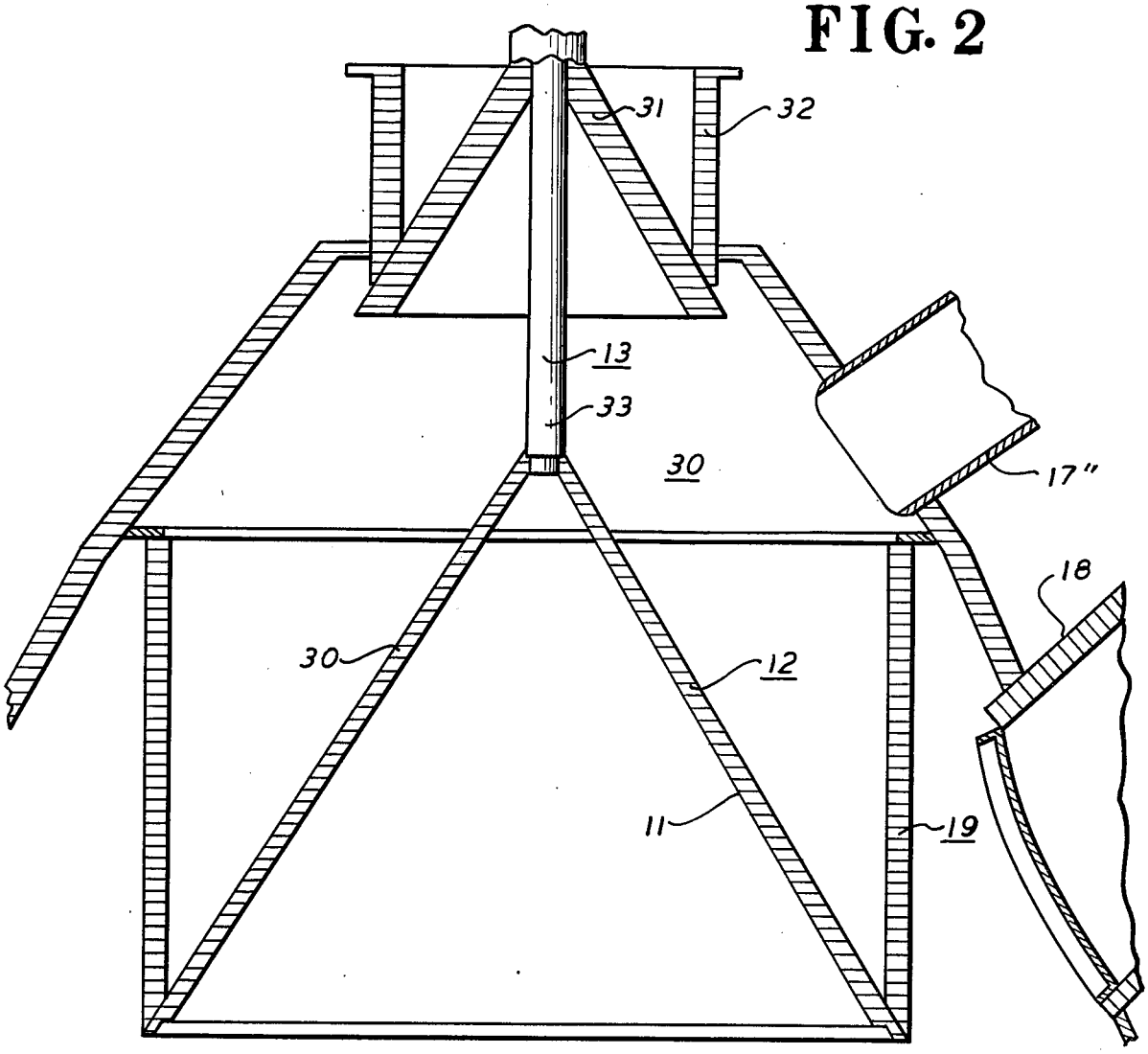
FIG. 2 is an elevational cross-sectional partly-fragmentary side view of the top closing device, of one of the uptakes, and of a duct from the pressure equalizing apparatus.
Figure 3:
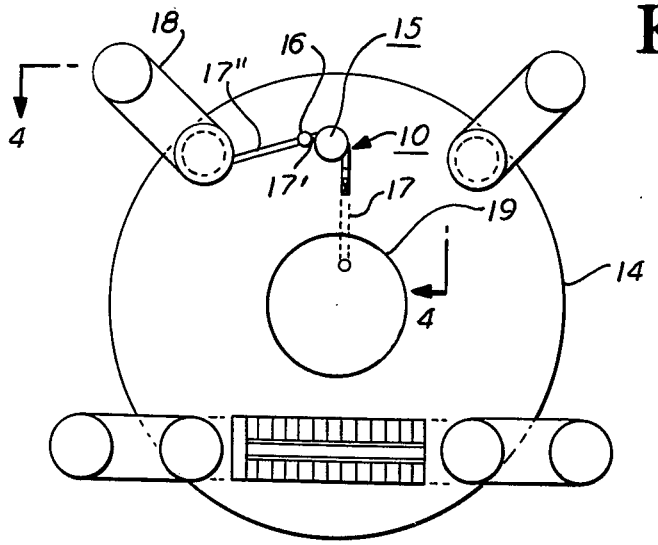
FIG. 3 is a top plan view of the blast furnace with the pressure equalizing apparatus connected thereto.
Figure 4:
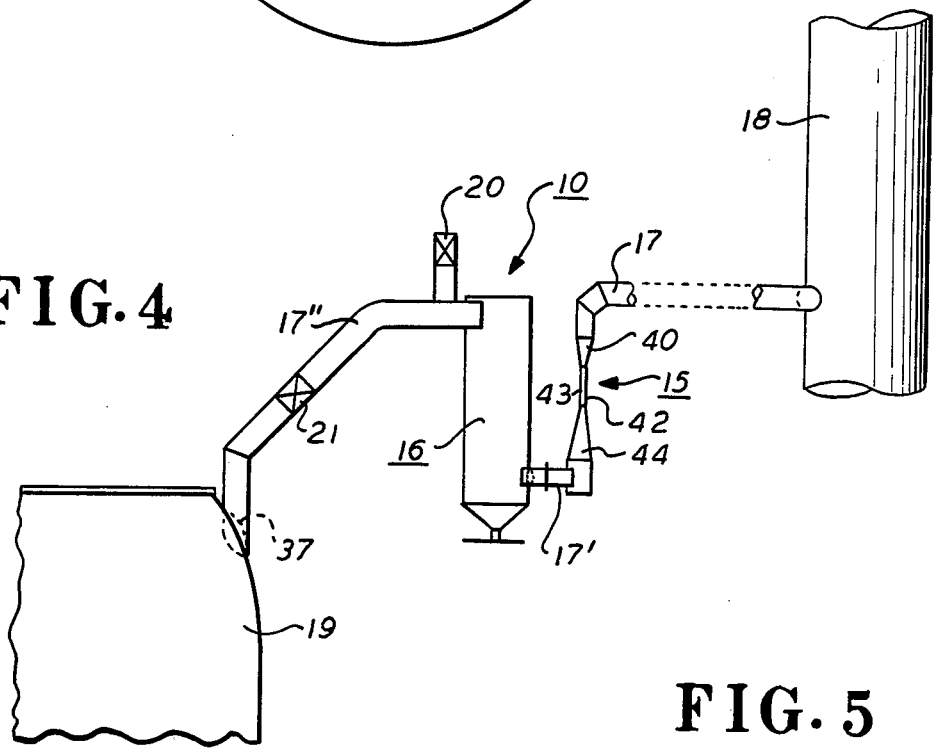
FIG. 4 is an elevational partly-fragmentary side view of the large bell hopper and one of the uptakes with the pressure equalizing apparatus connected thereto.
Figure 5:
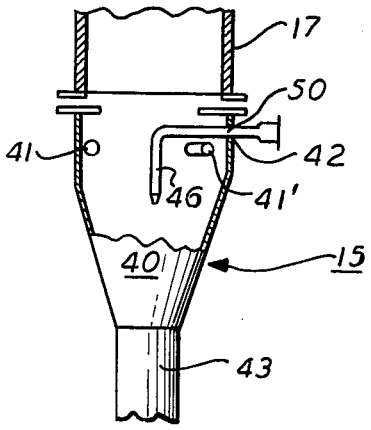
FIG. 5 is an elevational partly-sectional side view of the scrubber and duct connected thereto, of the pressure equalizing apparatus.

In the preferred embodiment of the invention, as illustrated in FIGS. 1-5, for example, the apparatus 10, for equalizing top pressure exerted on the bottom surface 11 of the large bell 12 operable in the top closing device 13 of the blast furnace 14, includes a venturi scrubber 15, located at the top of the blast furnace 14, a separator 16, mounted at the top of the blast furnace 14, ducts 17, 17', 17'' connected to one of the uptakes 18 of the blast furnace 14, the venturi scrubber 15, the separator 16, and the large bell hopper 19 of the top closing device 13 of the blast furnace 14, a valve 21, mounted in the duct 17'', and a valve 20, connected to the duct 17''.

The large bell 12 further includes a top surface 30. The top closing device 13 further includes a small bell 31, a small bell hopper 32, and an operating mechanism 33 connected to the large bell 12 and small bell 31 for controlling the movement thereof. The venturi scrubber 15 includes a converging end portion 40, to which duct 17 is connected, including tangential openings, 41, 41' and opening 42 therein, a medial restricted throat portion 43 connected to the converging end portion 40, including openings therein, and a diverging end portion 44, connected to the medial restricted throat portion 42, and to which the duct 17' is connected. An ejector 50 extends through the opening in the converging end portion 40 of the venturi scrubber 15. The tangential openings 41, 41' in the converging end portion 40 of the venturi scrubber 15 and the ejector 50 are connected to sources of water under pressure, which direct water therethrough. The openings in the medial restricted throat portion 43 of the venturi scrubber 15 are connected to a source of gas under pressure, which directs gas therethrough.

In operating the blast furnace 14 at internal pressures, so as to generate increased production of pig iron from charge fed thereinto stepwise through the top closing device 13, top gas, which includes carbon monoxide pollutants therein, is formed at the top of the blast furnace 14. Such top gas flows through the uptakes, such as 18, 18', one of which, such as 18, includes duct 17 connected thereto, through which a portion of the top gas flows into the venturi scrubber 15, to which the duct 17 is connected. Water under pressure is directed through the tangential openings 41, 41' in the converging end section 40 of the venturi scrubber 15, and swirls down and about the wall of the converging end portion 40. The top gas and water then flow into the medial restricted throat portion of the venturi scrubber 15, where gas under pressure is directed through openings therein, such that a turbulent action is generated which reduces the water into fine droplets and impresses thereon pollutants from the top gas. The top gas, with the pollutants removed therefrom by such turbulent action, and the fine water droplets with such pollutants impressed thereon, then flow through the diverging end portion 44 of the venturi scrubber 15 and the duct 17' into the separator 16, wherein the fine water droplets with pollutants impressed thereon are separated from the stream of top gas with the pollutants removed therefrom. The scrubbed top gas then flows through duct 17' and, upon opening valve 21, into the large bell hopper 19 so as to exert equalizing pressure on the top surface 30 of the large bell 12, and so as to enable variation of pressure therein from full to zero top gas pressure.

As the pressure exerted by the scrubbed top gas on the top surface 30 of the large bell 12 builds up to full furnace pressure, the flow of scrubbed top gas into the large bell hopper 19 diminshes, whereupon water under pressure directed through the ejector 50 into the stream of top gas flowing through the venturi scrubber 15 generates a continued flow of scrubbed top gas into the large bell hopper 19, so as to prevent back flow and venting of polluted furnace gas to atmosphere and so as to prevent the formation of pockets of stagnent gas.

The location of the apparatus and of the elements thereof at the top of the blast furnace 14 prevents the generation of substantial pressure drops therein, so as to enable equalization of the increased top gas pressure, and minimizes exposure of the elements thereof to ambient weather conditions, so as to prevent interference therefrom with the operation thereof.

Valve 21 is closed only during opening and closing ofthe small bell 31, not during and closing of the large bell 12, so as to enable efficient operation thereof.

Valve 20 is opened upon the generation of a pressure surge in the blast furnace 14, venting scrubbed gas to atmosphere at a location proximate the blast furnace 14, so as to enable efficient and effective relief of pressure surges thereby.

The apparatus 10 may be located remote from the top of the blast furnace, 14, as adjacent a large gas scrubber in the blast furnace system, with some pressure drop through the apparatus 10 resulting therefrom, but such pressure drop is not sufficiently large to prevent efficient operation of the apparatus 10.

The invention has been set forth above in terms of a specific embodiment theeeof; however, it is to be understood that variations may be made therein by those skilled in the art which variations may nevertheless be within the scope and spirit of the invention. The invention is therefor to be broadly construed within the scope and spirit of the claims appended hereto.

I claim:

1. An apparatus for equalizing high pressure exerted by top gas generated in a blast furnace operable so as to generate high pressure top gas, on the bottom surface of a large bell, openable to the top of a blast furnace, and operable in a large bell hopper in a top closing device in the blast furnace, comprising:

(a) means for cleaning the top gas and directing cleaned top gas into the large bell hopper so as to exert pressure on the top surface of the large bell which equalizes the pressure exerted by top gas in the blast furnace on the bottom surface of the large bell, to enable operation of the large bell for charging the blast furnace, and (b) means for maintaining substantially continuous flow of cleaned top gas into the large bell hopper, as the pressure exerted by the cleaned top gas on the top surface of the large bell builds up to the high pressure of the top gas in the blast furnace, and as the flow of cleaned top gas into the large bell hopper diminishes, so as to prevent back flow and venting of polluted top gas to atmosphere, and so as to prevent formation of pockets of stagnent gas.

2. An apparatus as in claim 1, in which the maintaining means comprise means for directing a stream of fluid under pressure into the stream of top gas directed into the large bell hopper.

3. An apparatus as in claim 2, in which the directing means comprise an ejector, including an end portion which extends in the direction of the path of the stream of top gas.

* * * * *